US006732524B2

(12) United States Patent
Spontón

(10) Patent No.: US 6,732,524 B2
(45) Date of Patent: May 11, 2004

(54) METHOD AND DEVICE FOR EXHAUST RECYCLING AND SUPERCHARGED DIESEL ENGINE

(75) Inventor: Ove Spontón, Vagnharad (SE)

(73) Assignee: Scania CV AB (publ) (SE)

( * ) Notice: Subject to any disclaimer, the term of this patent is extended or adjusted under 35 U.S.C. 154(b) by 0 days.

(21) Appl. No.: 10/296,266

(22) PCT Filed: May 16, 2001

(86) PCT No.: PCT/SE01/01084

§ 371 (c)(1),
(2), (4) Date: Nov. 21, 2002

(87) PCT Pub. No.: WO01/90560

PCT Pub. Date: Nov. 29, 2001

(65) Prior Publication Data

US 2004/0011036 A1 Jan. 22, 2004

(30) Foreign Application Priority Data

May 22, 2000 (SE) ..... 0001897

(51) Int. Cl.[7] ..... F02B 33/44

(52) U.S. Cl. ..... 60/605.2; 123/568.17; 123/568.12; 239/406

(58) Field of Search ..... 60/605.2; 123/568.17, 123/568.12; 239/406, 419, 419.5, 425.5, 428.5, 434.5

(56) References Cited

U.S. PATENT DOCUMENTS 4,249,382 A 2/1981 Evans et al. ..... 60/605.2
5,611,203 A 3/1997 Henderson et al. ..... 60/605.2
5,611,204 A 3/1997 Radovanovic et al. ..... 60/605.2
6,062,027 A * 5/2000 Landfahrer et al. ..... 60/605.2
6,408,833 B1 * 6/2002 Faletti ..... 60/605.2

FOREIGN PATENT DOCUMENTS

DE 4429232 C1 * 9/1995 ..... F02M/25/07
WO 99/40312 8/1999 ..... 123/568.17
WO WO 02/18773 A1 * 7/2002 ..... F02M/25/07

OTHER PUBLICATIONS

International Search Report.

* cited by examiner

*Primary Examiner*—Thomas Denion
*Assistant Examiner*—Thai Ba Trieu
(74) *Attorney, Agent, or Firm*—Ostrolenk, Faber, Gerb & Soffen, LLP

(57) ABSTRACT

A method and a device for exhaust gas recycling (EGR) in a combustion engine having two exhaust collectors. EGR gasses from the two exhausts collectors are combined in a mixing section of the EGR channel where they are accelerated, in a contraction portion, mixed and expanded. EGR gasses from a first exhaust collector are led into a first and EGR gasses from a second exhaust collector are led into a second portion of the contraction portion, which is arranged sideways with respect to the first portion of the contraction portion and separated therefrom up to the upstream area of the transition portion.

20 Claims, 4 Drawing Sheets

METHOD AND DEVICE FOR EXHAUST RECYCLING AND SUPERCHARGED DIESEL ENGINE

FIELD OF THE INVENTION

This invention concerns a method and a device for recycling exhaust gas recycling gasses to a combustion engine intake and particularly to handling exhaust gas from two exhaust collectors. It also concerns a supercharged diesel including such a device.

DESCRIPTION OF PRIOR ART

In turbo-supercharged diesel engines it is previously known to recycle exhaust gases to the engine inlet in order to reduce contents of nitrous oxides in the exhaust gases. Hereby the recycled exhaust gases function so as to lower the combustion temperature resulting in that a smaller amount of the nitrogen in the inlet air can be converted into nitrogen oxides. This process, usually called EGR (exhaust gas recirculation) has often been used in Otto engines as a relatively simple way of reducing the contents of harmful exhaust gas emissions. In diesel engines, on the other hand, this technique has not been employed to such a great extent depending i.a. on the fact that there are particular problems associated with these engines, making Otto engine solution not directly applicable in diesel engines.

One of these particular problems is that the combustion in diesel engines normally occurs with excess air. This indirectly results in need of transferring relatively large amounts of exhaust gases during a relatively large operating range of the engine in order to achieve the desired function. This problem is accentuated in case of an engine of the supercharged type, because in that case the pressure in the intake system of the engine is greater than the pressure in the exhaust gas system during a great part of the operating range.

Among known solutions to be used in supercharged engines, two main principle solutions can be distinguished, usually named "short route EGR" and "long route EGR". In the first mentioned case exhaust gases are taken from a position before an exhaust turbine in the exhaust system and is recycled to a position after an intake air compressor which is arranged in the intake system. In the latter case exhaust gases are taken from a position after the exhaust turbine and are recycled to a position before the intake air compressor. Both of these principle solutions have advantages and disadvantages.

Also U.S. Pat. No. 5,611,203 and U.S. Pat. No. 5,611,204 could be mentioned as previously known art with respect to this invention. These documents describe how exhaust gases are recycled to the intake in turbo-supercharged diesel engines through a venturi device or any other kind of ejector being placed in the intake channel. The system according to these documents uses the low static pressure prevailing in a certain section of the ejector device for pumping-in an EGR flow into the charged air.

In supercharged diesel engines having double exhaust collectors, some times only exhaust gases from one of these exhaust collectors are used as an EGR source which however results in an uneven EGR flow which in turn may affect the engine so that a correspondingly uneven operation will result.

In previously known devices where both exhaust collectors are being used as an EGR source indeed a more even EGR flow has been obtained, but at the fusion of the gas streams, a cross flow easily occurs from that channel where, at the moment, the highest pressure prevails, to the channel where the lower pressure prevails. This means that taken together, a lower pressure of accessible EGR gases will result and thus an increased power need in order to pump them into the intake channel of the engine.

There is also a risk for a negative effect on the turbo operation, since available energy may be reduced.

In order to avoid these problems it has been suggested to provide one-way valves in the channels up-stream the point of fusion, but this results in an unwanted pressure drop and lower reliability of operation and increased costs.

SUMMARY OF THE INVENTION

It is an aim of this invention to provide a solution to or a reduction of the problems of the prior art. A main aim of the invention is thus to provide a simple, long life, economic and effective solution for EGR transfer.

According to the invention this is achieved in a method and a device having a mixing section for mixing gasses from two exhaust collectors using, in the flow direction, a contraction section for each flow from an exhaust collector, followed by a common transition section followed by an enlarged diffuser section.

Through the invention it is achieved that EGR gases are accelerated in the contraction portion, resulting in an increase of the dynamic pressure during simultaneous reduction of the static pressure. By designing the contraction portion such that the accelerated EGR gases from the exhaust collector with the highest prevailing pressure are accelerated so that their static pressure correspond to the static pressure of the EGR gases from the exhaust gas collector with the lowest pressure, at the moment, no cross flow will occur and it will be secure to combine the channels. The leak flow between the collectors thereby has been eliminated through solely flow modifying measures and without any use of valves of the Reed type or the like. Further, a back flow from the upstream side is avoided.

Further, the transition portion is constructed such that the gas stream from that part of the contraction portion, where at the moment the highest pressure prevails, easily goes over to and adjoins with the "opposite" side during simultaneous continuous adjoining to its "own" side.

Further, the diffuser portion is constructed such that the gas stream continues to adhere and adjoin to the wall of the diffuser portion over its entire length without any vortex formation occurring through diversion of flow. This is obtained by testing and dimensioning of the different portions of the mixing section while considering for example the temperature gradient and the density gradient of the gas as seen in the length direction of the mixing section. As an example it could be mentioned that the cross-section of the transition portion is preferably elongated, essentially rectangular, or at least almost slot-shaped, with the dimensions, as an example for a six cylinder diesel engine having a cylinder volume of about 11 liters, ca 12 mm×25 mm.

By shaping the wall separating the parts of the contraction portion as a plate having its down stream edge ended with a sharp edge or sharply cut-off edge, simple production and effective function is achieved.

Further features and advantages of the invention will come clear from the following description of embodiments.

BRIEF DESCRIPTION OF DRAWINGS

Embodiments exemplifying the invention will now be described in more detail with reference to the annexed drawings, wherein.

DESCRIPTION OF EMBODIMENTS

Figure 1:
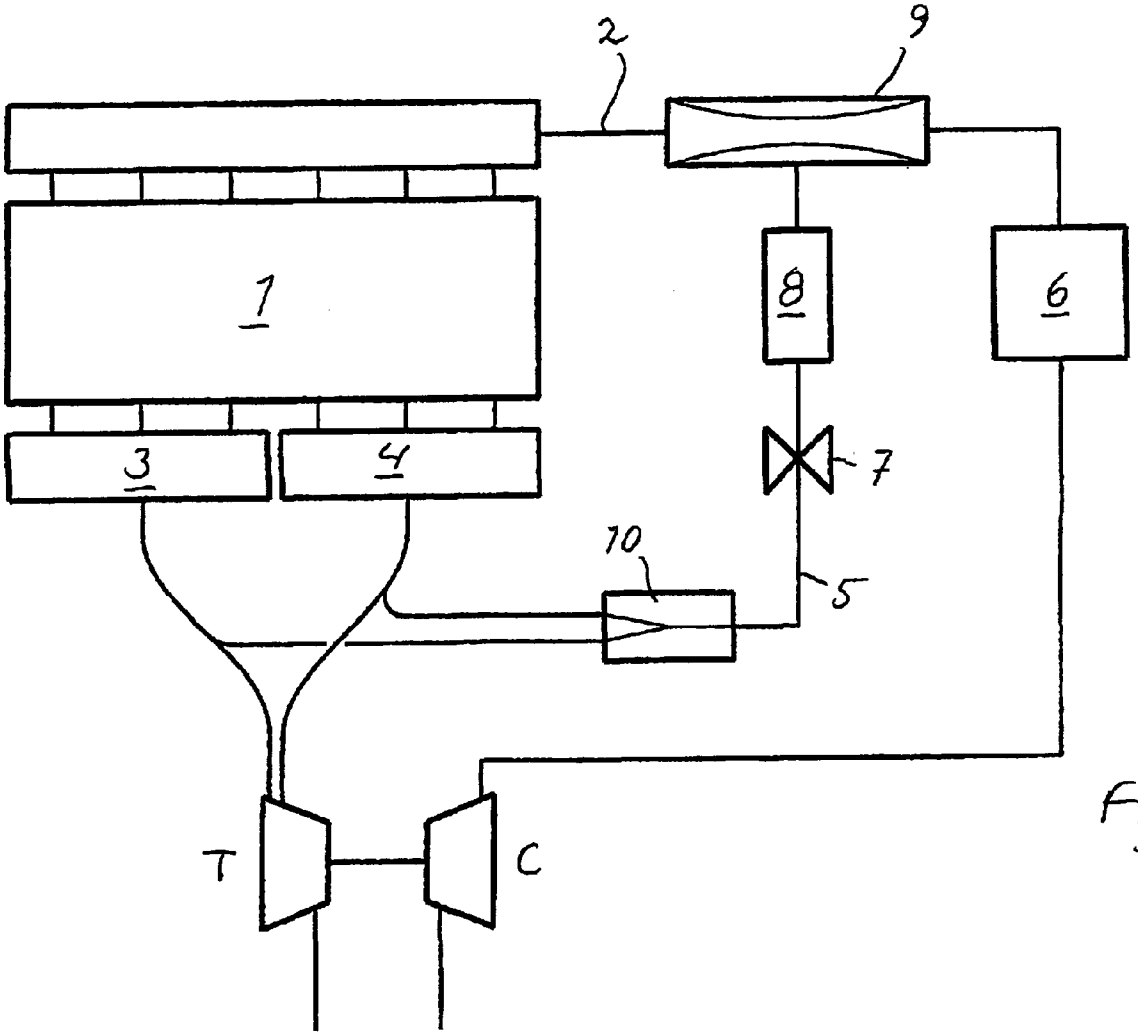
FIG. 1 diagrammatically shows an embodiment of the invention in connection with a four-stroke turbo-supercharged diesel engine.

FIG. 1 shows diagrammatically a combustion engine 1 of the piston engine type with a cylinder arranged in a straight inline cylinder block. The engine is a four-stroke diesel engine adapted for a heavy vehicle such as a truck or a bus. Each cylinder is in its respective cylinder head in a conventional manner provided with at least one intake valve for supply of combustion air and at least one exhaust valve for discharge of exhaust gases from the combustion. An intake channel 2 leads the intake air to the cylinders whereas two exhaust collectors 3 and 4 lead the exhaust gases from the cylinders to the turbine T and subsequently to the exhaust pipe.

Further, a transfer channel 5 is arranged for recycling EGR gases from the exhaust side of the cylinders to their intake side. The transfer channel 5 debouches in the intake channel 2 after a charging air cooler 6 and before a manifold to the cylinders. An EGR control valve 7 is positioned in the transfer channel whereby the transfer may be disconnected and possibly controlled to a certain extent. An EGR cooler is indicated with 8.

The transfer channel 5 debouches in a section 9 of the intake channel 2 wherein a venturi 9 is arranged in such a way that the flow of intake gases, which are charged by the compressor C, is modified so as to create a negative pressure at the passage of the venturi. The EGR gases are led-in in said section where thus a negative pressure prevails. By shaping the venturi device it could be ensured that an adequate negative pressure may be achieved so that a suitable amount of EGR gases can be transferred. Normally between 0 and about 20% of the exhaust gas amount is used as EGR gases.

Further there is arranged a mixing section 10 in the transfer channel wherein EGR gases from both exhaust gas collectors enter in order to be combined into one single channel 5.

Figure 2A:
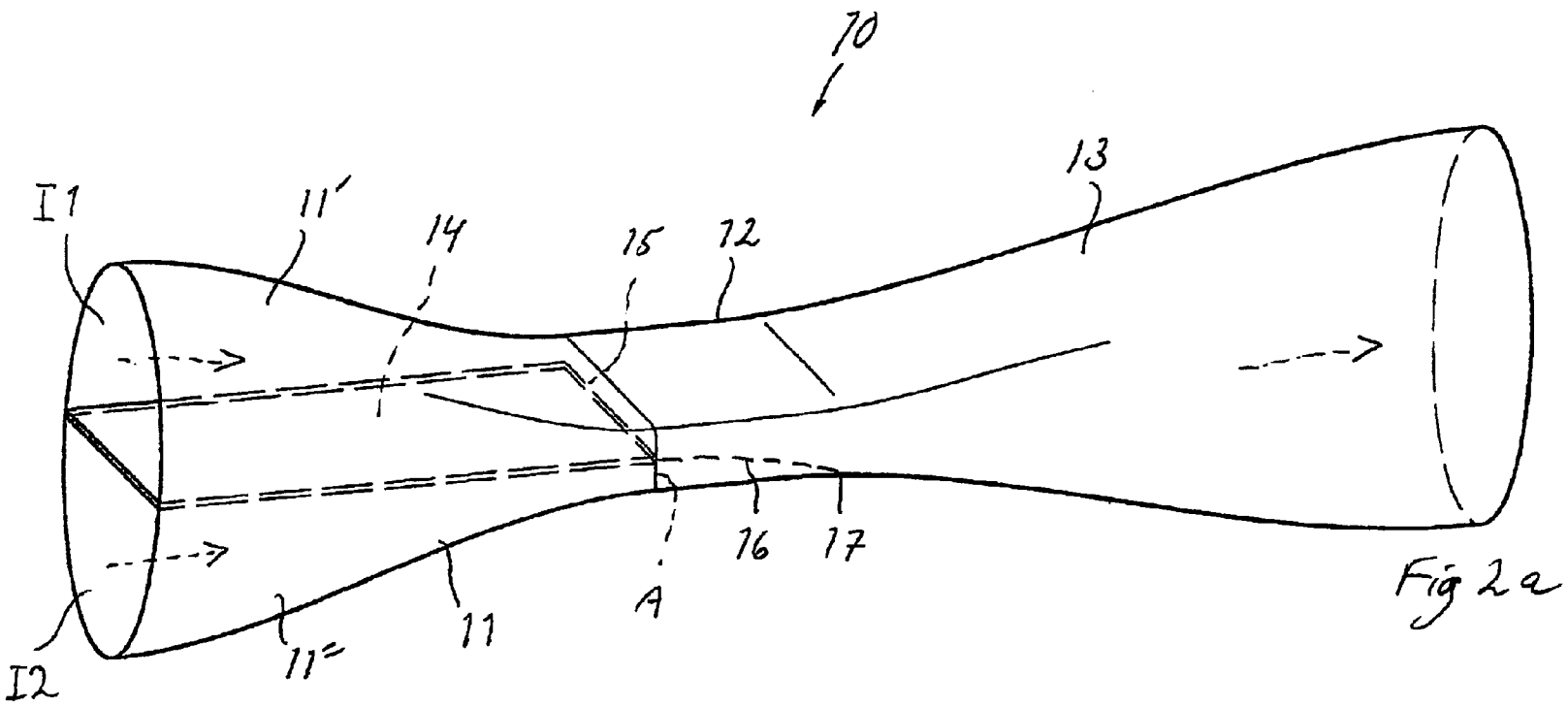
FIG. 2*a* shows in more detail a device according to one embodiment of the invention.

In FIG. 2*a* the section 10 is shown in more detail, where the contraction portion 11 is shown, which thus is a more or less funnel-shaped channel restriction, and wherein the gases are accelerated. The contraction portion is comprised of a first 11' and a second 11" channel portion, each communicating with one of the exhaust collectors of the engine. The channel portions have at their inlets I1 and I2, respectively, essentially semicircular section and are successively transformed to rectangular cross section in the direction of the downstream end A of the contraction portion. At the inlets I1 and I2 also other sections may be possible, for example semi-elliptic.

Between the channel portions 11' and 11" there is arranged a partition wall 14 being comprised of a plate with, in this example, a downstream edge 15 terminated with a sharply cut-off edge in order to obtain good flowing properties at this position. 12 indicates the transition portion wherein the accelerated gas bridges the distance from the edge 15 to the opposite side at 17. This is indicated with interrupted line at 16 in case the highest pressure prevails in the portion 11', and thus the gas has to bridge the distance below, as seen in the figure, the edge 15 over to the underside (at 17) of the transition portion.

When the gases from the channel portion 11' fill the entire cross-section of the section 10, pressure gain will be obtained through expansion in the diffuser 13, so that the static pressure in the channel after the section 10 essentially is the highest pressure prevailing in any of the two exhaust collectors 3 and 4.

Figure 2B:
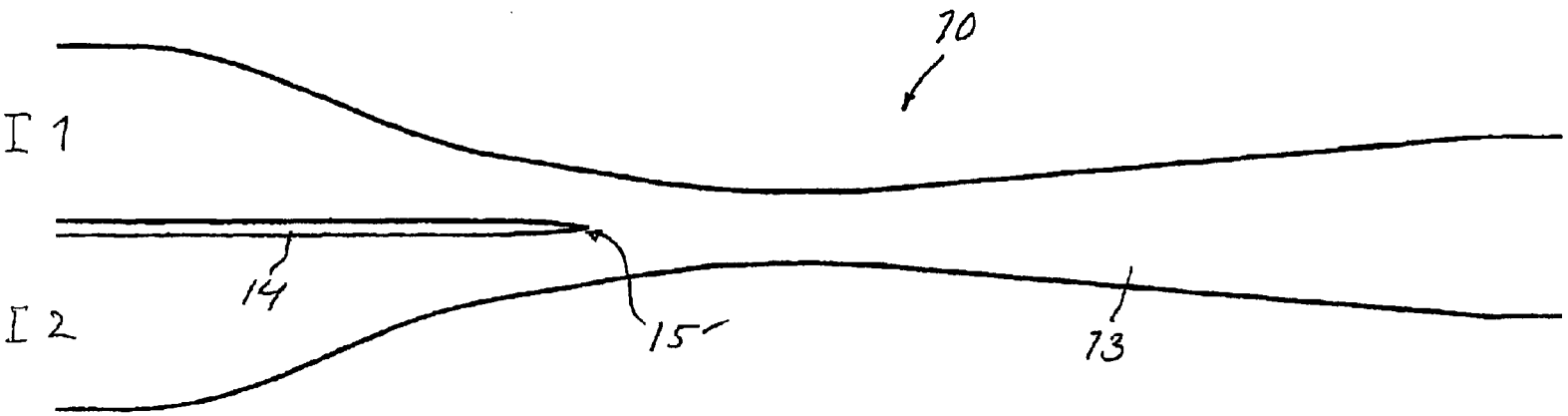
FIG. 2*b* shows diagrammatically a device according to a variant of the invention.

FIG. 2*b* only intends to show that a downstream edge 15' with sharp edge is possible instead of the sharply cut-off edge shown on FIG. 2*a*.

Figure 3:
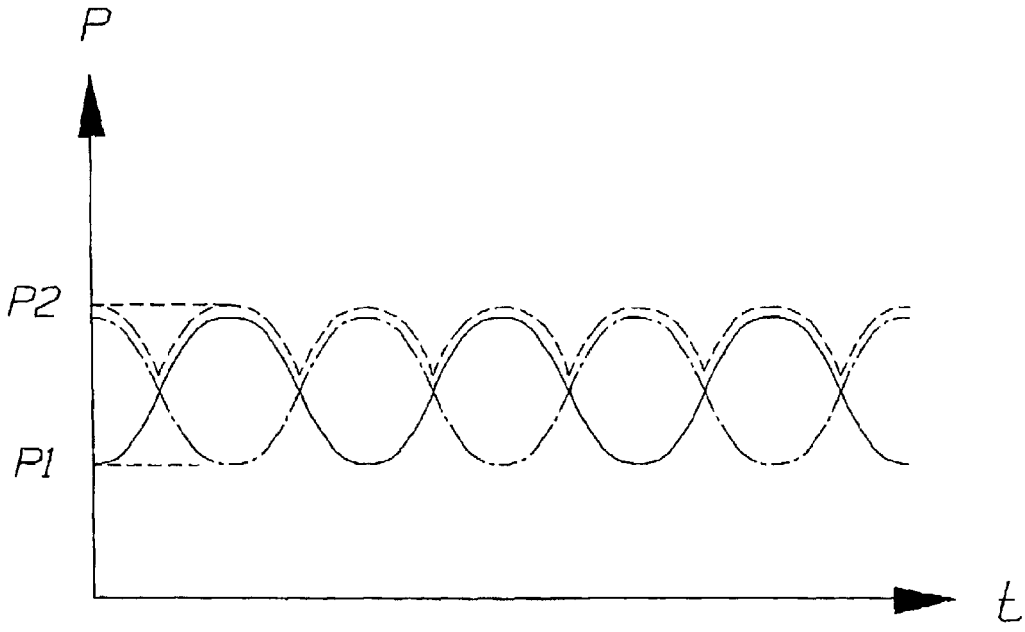
FIG. 3 shows pressure as a function of time in two exhaust collectors of a diesel engine.

In FIG. 3 is diagrammatically shown, with a full line, the pressure in one of and with a dot interrupted line the pressure in the other of the exhaust collectors of the diesel engine in FIG. 1. As can be seen, this pressure varies between values P1 and P2, where the top value P2 occurs in connection with an exhaust pulse, and where P1 is typically about ¼ of P2. A pure combination of the gases in the respective exhaust gas collectors would result in a pressure near 0,6 P1. The invention, however, makes it possible to effectively take advantage of the energy in the exhaust pulses which results in that an essentially higher pressure is obtained, which is indicated with the interrupted line, i.e. essentially all pulse energy is utilised.

Alternative constructions of the section 10 are possible. For example the contraction portions may extend in a certain angle relative to each other and the plate 14 may be exchanged with another separating element.

The cross section over the length of the section may also be different, and as an example, the parts of the contraction portions may be terminated with funnel sections having curved instead of straight sections.

The invention has been described at the background of a supercharged diesel engine but it is also applicable in other combustion engines wherein similar problems and conditions prevail.

What is claimed is:

1. A method of exhaust gas recycling in a combustion engine, wherein the combustion engine has two separate exhaust from the engine, an intake channel into the engine and an exhaust gas recycling gasses channel which supplies recycling gasses to the intake channel from the exhaust collectors in order that the recycling gasses be led to the engine together with intake air;

the method comprising:

leading the exhaust gas recycling gasses from the first exhaust collector into a first portion of a contraction portion of a mixer, wherein the gasses are contracted and accelerated; leading the exhaust gas recycling gasses from the second exhaust collector into a second portion of the contraction portion of the mixer, wherein the second portion is toward the side of the first portion of the contraction portion and wherein the gasses are contracted and accelerated; and separating the gasses exiting from the first and second exhaust collectors for the gasses to pass through the first portion and the second portions of the contraction portion;

the method further comprising leading the gasses into a transition portion which follows the contraction portion combining the exhaust gas recycling gasses at an upstream area of the transition portion;

leading the combined gasses from the transition portion to a diffuser portion which follows the transition portion and leading the gasses from the diffuser portion to a venturi and from the venturi to the intake to the engine.

2. The method of claim 1, wherein the transition portion has an elongated essentially rectangular cross-section.

3. The method of claim 1, further comprising recycling from the exhaust collectors between 0 and about 20% of the exhaust gasses as exhaust gas recycling gasses.

4. The method of claim 1, further comprising pumping the exhaust gas recycling gasses into the intake channel of the engine.

5. The method of claim 4, wherein the pump element comprises a venturi device in the intake channel; the method comprising pumping the exhaust gas recycling gasses to the venturi.

6. A device for exhaust gas recycling in a combustion engine, wherein the engine includes cylinders, an intake channel for intake of exhaust gasses and air into the engine cylinder, and an exhaust gas recycling channel for feeding exhaust gasses into the intake channel so that exhaust gas recycling gasses and intake air are led to the engine;

the device comprising:

first and second exhaust gas collectors for respective first and second ones of the engine cylinders;

the exhaust gas recycling channel having a mixing section therein for receiving exhaust gas recycling gasses from the first and second exhaust collectors and for combining the exhaust gas recycling gasses from the first and second collectors;

the mixing section comprising, in the flow direction, a contraction portion of reduced cross-section which contracts and accelerates the gasses; the contraction portion having a first portion connected with the first exhaust collector to receive gasses from the first exhaust collector and a second portion connected with the second exhaust collector for receiving gasses from the second exhaust collector; the first and second portions of the contraction portion being arranged side by side next to each other;

a transition portion after the contraction portion and a diffuser portion after the transition portion; and a separating device in the contraction portion separating the first and second portions up to an upstream end of the transition portion.

7. The device of claim 6, wherein the transition portion has an elongated essentially rectangular cross-section.

8. The device of claim 7, wherein the diffuser portion has an exit section that is essentially circular in cross-section.

9. The device of claim 8, wherein each of the first and second portions of the contraction portion has a semi-circular or a semi-elliptic cross-section.

10. The device of claim 7, wherein each of the first and second portions of the contraction portion has a semi-circular or a semi-elliptic cross-section.

11. The device of claim 6, further comprising devices for sending between 0 and about 20% of the exhaust gasses from the exhaust collectors to the mixing section to be used as exhaust gas recycling gasses.

12. The device of claim 11, further comprising a control valve for exhaust gas recycling gasses for controlling the amount of the gasses to the mixing section.

13. The device of claim 6, wherein the separating device in the contraction portion comprises a plate in the contraction portions separating the first and second portions of the contraction portion, the plate having a downstream edge at the upstream end of the transition portion.

14. The device of claim 13, wherein the downstream edge of the plate is terminated by an essentially sharp edge or a sharply cut off edge.

15. The device of claim 6, wherein the diffuser portion has an exit section that is essentially circular in cross-section.

16. In combination, the device of claim 6 and a combustion engine, wherein the engine includes:

the engine cylinders, the intake channel for exhaust gas and air into the engine, an exhaust gas recycling channel for feeding exhaust gasses into the intake channel into the engine so that exhaust gas recycling gasses and intake air are led to the engine; and the first and second exhaust collectors for respective ones of the cylinders from the engine.

17. The device of claim 6, further comprising a control valve for exhaust gas recycling gasses for controlling the amount of the gasses to the mixing section.

18. The device of claim 16, further comprising a venturi device arranged in the intake channel of the engine.

19. The device of claim 6, further comprising a venturi device arranged in the intake channel of the engine.

20. The device of claim 19, wherein the exhaust gas recycling gasses after the diffuser section communicate to the intake channel at the venturi device.

* * * * *